United States Patent [19]

Nagamoto et al.

[11] Patent Number: 4,825,179

[45] Date of Patent: Apr. 25, 1989

[54] ELECTROMAGNETIC RELAY WITH PIVOTABLE ARMATURE

[75] Inventors: Mitsuki Nagamoto; Masayuki Shiomi, both of Tsu, Japan

[73] Assignee: Matsushita Electric Works, Ltd., Kodoma, Japan

[21] Appl. No.: 167,281

[22] Filed: Mar. 11, 1988

[30] Foreign Application Priority Data

Mar. 20, 1987 [JP] Japan ..... 62-041887[U]

[51] Int. Cl.[4] ..... H01H 51/22

[52] U.S. Cl. ..... 335/80; 335/128

[58] Field of Search ..... 335/78–85, 335/128, 129, 130, 131

[56] References Cited

U.S. PATENT DOCUMENTS 4,758,809 7/1988 Bell ..... 335/80

4,761,627 8/1988 Bell ..... 335/80

*Primary Examiner*—E. A. Goldberg

*Assistant Examiner*—Lincoln Donovan

*Attorney, Agent, or Firm*—Armstrong, Nikaido, Marmelstein & Kubovcik

[57] ABSTRACT

A relay has a contact assembly and an electromagnet with a L-shaped pivotable armature rockable with its inside angle supported against a complementary yoke edge. A base mounting the electromagnet and the contact assembly is formed with a retainer rib which is opposed to the yoke edge so as to loosely engage the angled portion of the armature therebetween but to prevent the inside angle of the armature from departing beyond an allowable distance from the yoke edge. A movable spring included in the contact assembly is operatively connected to a first leg of the L-shaped armature so as to be driven thereby to close the contacts in response to the energization of the electromagnet. The armature in the reset position has its free end rest on a fulcrum projection on the base and receives a return bias from the movable spring at a point inwardly of the fulcrum projection such that the return bias of the movable spring acts as a torque which causes the armature within the allowable distance from the yoke edge to pivot about the fulcrum in a direction of urging the inside angle of the armature toward the yoke edge to such an extent that, upon energization of the electromagnet, the inside angle of the armature can be firstly attracted to the yoke edge into exact coincidence therewith, ensuring an accurate pivotal movement about the yoke edge without requiring a conventional retainer spring which constantly urges the inside angle to the yoke edge.

4 Claims, 4 Drawing Sheets

ELECTROMAGNETIC RELAY WITH PIVOTABLE ARMATURE

BACKGROUND OF THE INVENTION

1. Field of the Invention

The present invention is directed to an electromagnetic relay with a generally L-shaped armature, and more particularly, to a miniature electromagnetic relay with such armature rockable about an edge of a cooperating yoke.

2. Description of the Prior Art

There have been provided a number of electromagnetic relays having a generally L-shaped armature which is pivotable between an attracted position and a reset position in response to energization and deenergization of a cooperating coil for contact closing and opening. In the prior art relays of such construction as proposed, for example, in U.S. Pat. Nos. 4,303,742, 4,429,292, 4,340,876, 4,124,832, 4,101,856, and 3,474,367, a retainer spring means is required to constantly press the angled portion of the L-shaped armature against an edge of a complementary yoke so that the armature can pivot with its inside angle kept in exact coincidence with the yoke edge to effect a reliable contact switching operation.

Many of such retainer spring means are presented in a complicated construction which necessitates collaborate assembly into the relay structure. To overcome this inconvenience, it has been an industry demand to design the retainer spring means in a simple construction easy to assemble. Even with a simple retainer spring means, the addition of the retainer spring means becomes hindrance to the miniaturization of the relay where the number of the parts can be reduced to a minimum, although it is not serious in a relay of larger construction. Consequently, it has been a long-felt need in designing a miniature relay to eliminate the retainer spring means from the relay while assuring a stable armature operation of pivoting between two contact switching positions.

SUMMARY OF THE INVENTION

In view of the above, the present invention has been accomplished to successfully eliminate such conventional retainer spring means from the relay structure while assuring stable pivotal armature movement by better utilization of a movable spring, essential part of the relay, as means for retaining an armature into a correct position. The relay in accordance with the present invention comprises a base mounting thereon an electromagnet and a contact assembly. The contact assembly includes a fixed contact and an elongated movable spring which carries at its one end a movable contact engageable with the fixed contact and is self-biased away from the fixed contact with the other end supported to the base. The electromagnet includes a core having first and second ends, a coil wound about the core, a yoke connected at its one end to the first end of the core and extending parallel to the core, and a generally L-shaped armature. The armature has a first leg extending along the yoke and a second leg extending over the second end of the core to define therebetween an air gap. The armature is rockable with its inside angle pivotally supported against an edge at the other end of the yoke for pivotal movement in response to the energization of the coil between an attracted position in which the second armature leg is attracted to the second end of the core and a reset position in which the second armature leg is spaced away from the first end of the core. The first armature leg is operatively connected to the movable spring through an electrically insulative actuator so as to drive the movable spring in a direction of engaging the movable contact with the fixed contact against the bias of the movable spring as the armature moves to its attracted position in response to the energization of the coil. Upon the deenergization of the coil the armature is driven to move back to the reset position under the bias of the movable spring. The characterizing feature of the present invention resides in that a stationary retainer means is provided on the base adjacent to the angled portion of the armature to loosely engage that angled portion between the yoke edge and the retainer means for preventing the inside angle of the armature from departing beyond a predetermined allowable distance from the yoke edge. Further, a fulcrum projection is provided on the base to receive the free end of the first armature leg when the armature is moved to its reset position under the bias of the movable spring. The actuator abuts against the first leg at a point inwardly of the fulcrum along the length of the first armature leg for transmitting to the armature the return bias of the movable spring as a torque which causes the armature within the allowable distance from the yoke edge to pivot about the fulcrum projection in a direction of urging the inside angle of the armature toward the yoke edge close enough so that upon the energization of the coil the inside angle of the armature can be firstly attracted to the edge of the yoke before the second armature leg is attracted to the core to substantially drive the movable spring by the first armature leg into contact with the fixed contact. In this manner the armature can have its inside angle in exact coincidence with the yoke edge prior to being pivoted to the attracted position. After shifted back to the exact position, the armature can follow a stable pivotal movement to the attracted position as a result of the energization of the coil and assure a constant pick-up voltage for contact closing. With this result, the relay can be dispensed with any conventional mechanical retainer spring means which holds the angled portion of the armature against the yoke edge. In this connection, since the armature can be corrected its position relative to the yoke edge prior to being pivoted to the attracted position, it is allowed to be mounted on the base with its angled portion loosely engaged between the yoke edge and the retainer means on the base, facilitating the assembly of the armature. Further, by better utilization of the movable spring as means for correcting the armature position, the correction of the armature position can be effected without requiring any additional members. All of these effects contributes to the miniaturization of the relay while assuring easy assembly thereof.

Accordingly, it is a primary object of the present invention to provide an electromagnetic relay in which the armature can effect a stable pivotal movement for contact closing without requiring any additional retainer spring means and can be easily assembled into the relay structure.

In preferred embodiment, the actuator abuts at its end on the first armature leg at such an inclined angle that the return bias from the movable spring applies to the armature a force which acts in a direction of urging the inside angle toward the yoke edge along the length of the yoke while applying the above torque to pivot the armature about the fulcrum projection. Thus, the position correction of the armature can be further improved so as to gives a greater allowable distance between the yoke edge and the retainer means within which the angled portion of the armature is received at the assembly.

It is therefore another object of the present invention to provide an electromagnetic relay in which the armature can have its position corrected effectively by the use of the movable spring.

The relay further includes a cover of electrically insulative material fitted over the base to form therebetween a mounting space for the electromagnet and the contact assembly. The base is integrally formed with a dividing wall which divides the mounting space into a magnet compartment for the electromagnet and a contact compartment for the contact assembly. The dividing wall is effective to electrically insulate the electromagnet from the contact assembly when the relay is miniaturized. The above retainer means and the fulcrum projection are formed at the ends of the dividing wall as the integrally molded members to keep the number of the assembled parts at a minimum. The retainer means is in the form of an arcuate rib having its inner curved surface centered at the yoke edge for effectively retaining the angled portion within the allowable distance from the yoke edge.

It is therefore a further object of the present invention to provide an electromagnetic relay in which the armature can be retained within the allowable distance from the yoke edge effectively and by better utilization of the dividing wall which insulates the electromagnet form the coil assembly.

The dividing wall is formed with a slit through which the actuator extends between the movable spring and the first armature leg for operatively connecting the armature and the movable spring. In a preferred embodiment, the actuator is provided at its ends with hooks each of which extends from the top end thereof and engages in a corresponding notch formed in each of the upper edges of the movable spring and the first armature leg so as to prevent undesired fluctuation of the actuator along the length of the movable spring and the first armature leg, which is therefore a still further object of the present invention.

These and still other objects and advantages will become more apparent from the following detailed description of the preferred embodiment of the present invention when taken in conjunction with the attached drawings.

DESCRIPTION OF THE PREFERRED EMBODIMENTS

Figure 1:
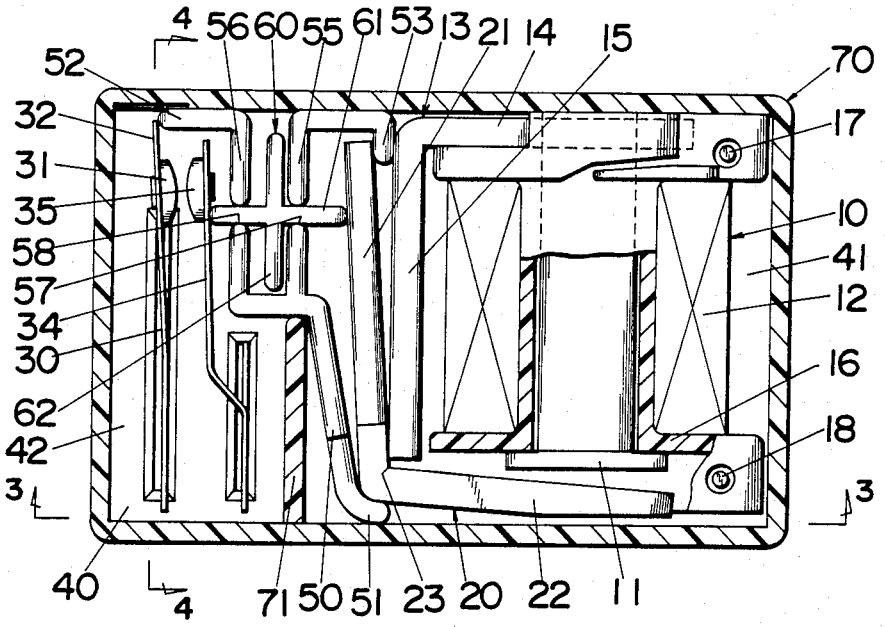
FIG. 1 is a top view, with an armature shown in its reset position, of an electromagnetic miniature relay in accordance with a first embodiment of the present invention.
Figure 2:
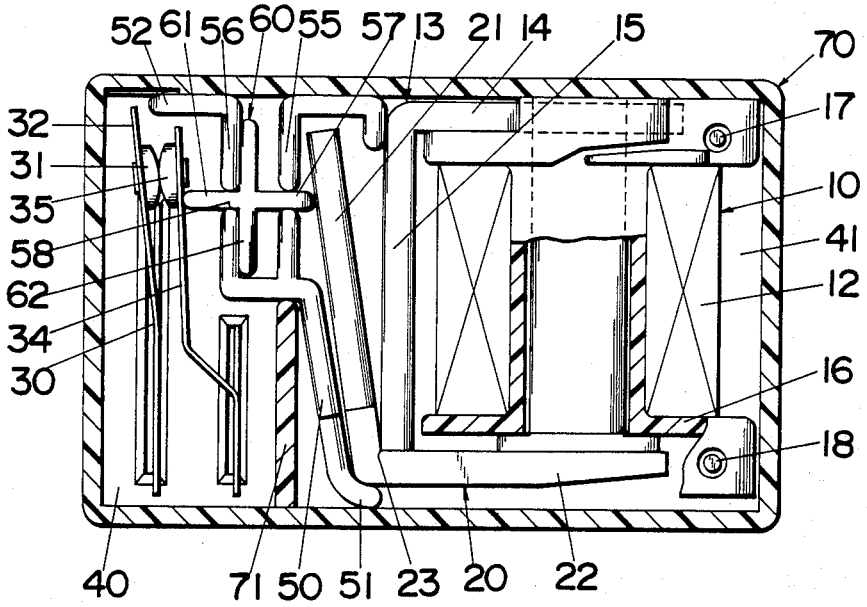
FIG. 2 is a top view of the relay with its armature shown in its attracted position.
Figure 3:
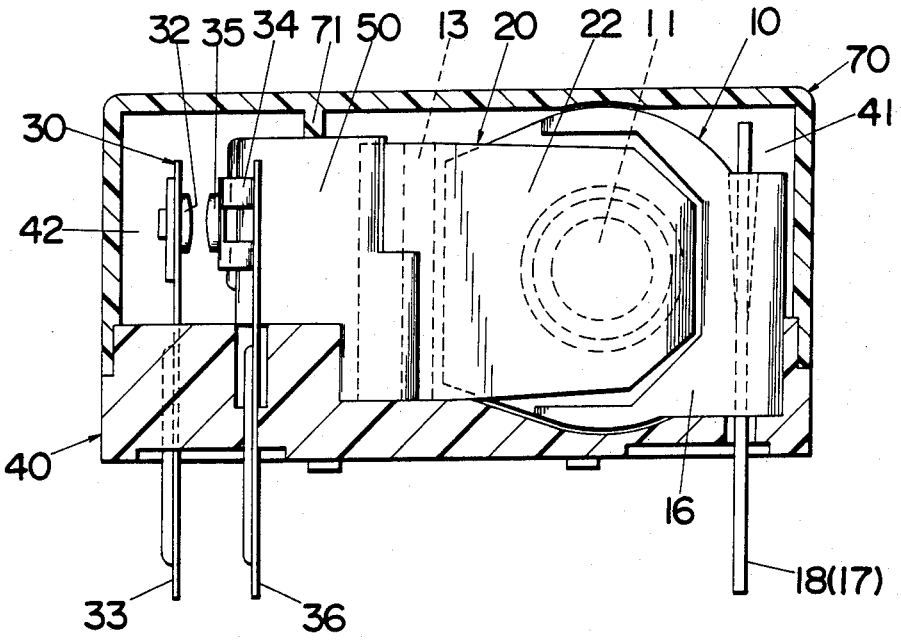
FIG. 3 is a cross section taken along line 3—3 of FIG. 1.

Referring now to FIG. 1, a miniature electromagnetic relay comprises an electromagnet 10 and a contact assembly 30 mounted on a rectangular base 40 molded from an electrically insulating material. A cover 70 also formed of electrically insulative material is fitted on the base 40 to form therebetween a sealed space for the electromagnet 10 and the contact assembly 30. A dividing wall 50 projects on the base 40 to divide the sealed space into a magnet compartment 41 for the electromagnet 10 and a contact compartment 42 for the contact assembly 30. The electromagnet 10 includes a core 11, a coil 12 wound about the core 11, a yoke 13, and a L-shaped armature 20. The core 11 extends through a coil bobbin 16 fixed on the base 40 and carrying thereabout the coil 12. The ends of the coil 12 are connected to the upper ends of coil terminals 17 and 18 which are molded in the bobbin 16 and have their respective lower end extending vertically through the base 40. The yoke 13 is formed into a L-shaped configuration with a horizontal segment 14 connected to one end of the core 11 and an upright segment 15 extending parallel to the core 11. The armature 20 is formed into a generally L-shaped configuration with a first leg 21 and a second leg 22 bent at an obtuse angle to each other. The first leg 21 extends along the upright yoke segment 15 so that the second leg 22 extends over the other end of the core 11 to define therebetween a air gap. The armature 20 is rockable with its inside angle 23 bearing against an edge at the free end of the upright yoke segment 15 for movement between an attracted position of FIG. 2 and a reset position of FIG. 1 upon energization and deenergization of the coil 12.

Formed at one end of the dividing wall 50 is an integral arcuate rib 51 which is opposed to the yoke edge and defines therebetween a gap for loosely retaining therein the angle portion of the armature 20. The rounded surface of the arcuate rib 51 has a radius centered at the yoke edge. The gap distance is selected to be great enough to facilitate the assembly of the armature 20 but is limited to such an extent that the inside angle 23 of the armature 20 is within an allowable distance from the yoke edge. By the allowable distance is meant that upon the energization of the coil 12 the armature 20 can be corrected its position to have its inside angle 23 into coincidence with the yoke edge before the armature 20 moves to the attracted position, or contact closing position.

Figure 4:
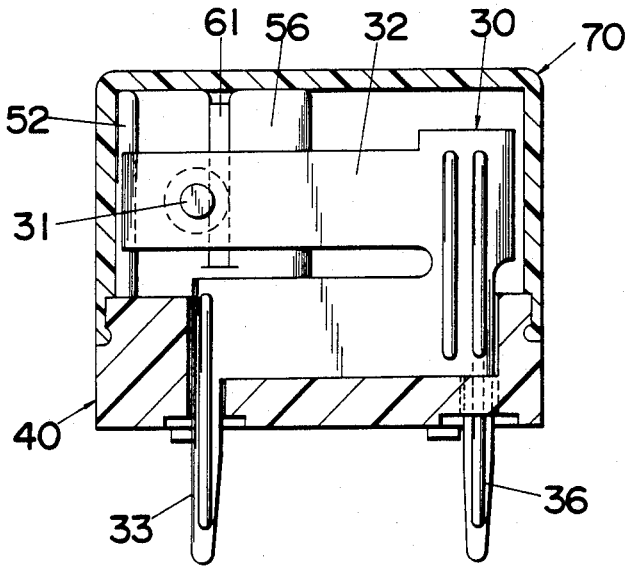
FIG. 4 is a cross section taken along line 4—4 of FIG. 1.
Figure 5:
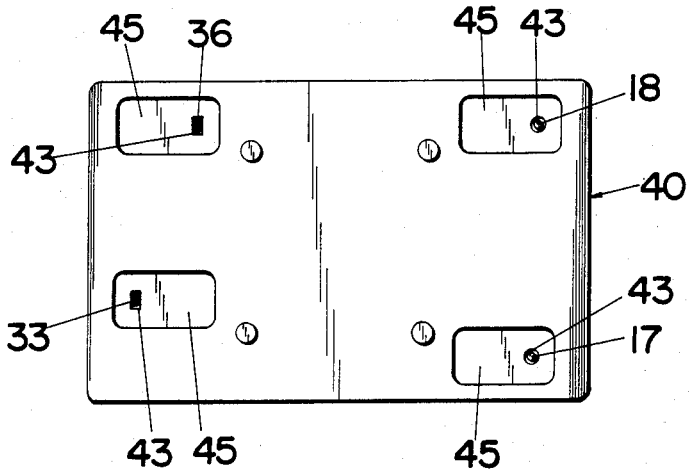
FIG. 5 is a bottom view of the above relay.

The contact assembly 30 comprises a stationary contact 31 and a movable spring 34 carrying thereon a movable contact 35 engageable with the stationary contact 31. The stationary contact 31 is held on an elongated spring 32 which is fixed at its one end to the base 40 with an integrally formed terminal 33 extending downwardly through the base 40, as best shown in FIG. 4. The free end of the spring 32 rests on a stop 52 at the end of the dividing wall 50 to retain the stationary contact 31 at a predetermined position relative to the movable contact 35 while it is capable of flexing outwardly together with the movable contact 35 when pressed by the movable contact 35 so as to produce a suitable contact pressure at the contact closing. The movable spring 34 extends generally in parallel relation with the spring 32 and is fixed at one end to the base 40 with an integrally formed terminal 36 extending downwardly through the base 40. The movable spring 34 is self-biased in a direction away from the stationary contact 31 and is connected to the first armature leg 21 through an actuator 60 to apply a return bias to the armature 20 while holding the actuator 60 between the movable spring 34 and the first armature leg 21. It is this return bias from the movable spring 34 that corrects the armature 20 into an optimum position for coherent pivotal movement from the reset position to the attracted position, as discussed below.

Figure 6A:
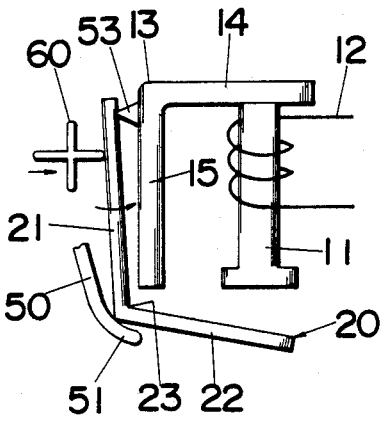
FIGS. 6A and 6B are schematic views respectively illustrating the operation of the armature.
Figure 6B:
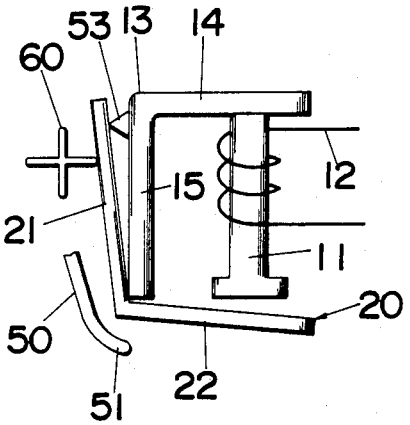

Formed at the end of the dividing wall 50 opposite to the arcuate rib 51 is a fulcrum projection 53 which abuts on the upright yoke segment 15 opposite to the yoke edge and which receives the free end of the first armature leg 21 when the armature 20 is in the reset position, or in the initially assembled position. At this position, the actuator 60 abuts at its one end against the first armature leg 21 at a point inwardly of the fulcrum projection 53 along the length of the first armature leg 21. Therefore, as shown in FIGS. 6A and 6B, the return bias from the movable spring 34 acts on the armature 20 as a torque about the fulcrum projection 53 which urges the inside angle 23 of the armature 20 toward the yoke edge to such a closer extent that, upon the energization of the coil 12, the inside angle 23 is firstly attracted to the yoke edge before the second armature leg 22 is attracted to the core 11. Consequently, while the armature 20 is within the allowed distance from the yoke edge as determined by the arcuate rib 51 in the reset position, it can be corrected its position to have its inside angle 23 into coincidence with the yoke edge prior to being attracted to the core 11, thus allowed to effect a stable and reliable pivotal movement about the yoke edge. With this result, the relay can be given a constant pick-up voltage for closing the contacts despite of the loose engagement of the armature 20 between the arcuate rib 51 and the yoke edge at the reset position or at the assembled position, thus greatly facilitating the assembly.

In addition to the above, the actuator 60 abuts at its one end against the first armature leg 21 at an inclined angle so that the return bias from the movable spring 34 applies a recover force to the armature 20 in the reset or the initially assembled position. The recover force acts in a direction of urging the inside angle 23 of the armature 20 toward the edge of the yoke 13 along the length of the upright yoke segment 15 simultaneously with the above pivotal movement of the armature 20 about the fulcrum projection 53, which serves to effectively correct the armature position prior to the energization of the coil 12, or the pivotal movement of the armature to the attracted position.

Further, the substantial portion of the first armature leg 21 except for the portion joining the second armature leg 22 has a reduced width than the other portion of the armature 20 to considerably increase magnetic resistance between the first armature leg 21 and the opposing upright yoke segment 15 as compared to the magnetic resistance between the second armature leg 22 and the core 11. Thus, the first armature leg 21 can be relatively free from receiving magnetic attraction from the opposed upright yoke segment 15 so as to concentrate the magnetic force between the inside angle of the armature 20 and the yoke edge, assisting the above position correction of the armature 20 at the very start of energizing the coil 12.

The end portion of the dividing wall 50 formed with the arcuate rib 51 has a height less than the remaining portion to facilitate the assembly of the armature 20 as well as reducing the friction between the armature 20 and the arcuate rib 51 returning to the reset position. The remaining portion of the dividing wall 50 extends the full height to the upper bottom of the cover 70 and is cooperative with a depending wall 71 from the cover 70 to effectively insulate the electromagnet 10 from the contact assembly 30. The depending wall 71 extends integrally from the side wall of the cover 70 to have its opposite end abutting against the portion of the dividing wall 50 with its bottom edge engaged with the top surface of the base 40.

Formed in the dividing wall 50 is a double-wall portion which is composed of a pair of spaced partitions 55 and 56 and through which the actuator 60 extends between the free ends of the movable spring 34 and the first armature leg 21. The actuator 60 is formed into a cross-shaped configuration with a horizontal member 61 and an upright member 62, and is slidably held on the base 40 with the horizontal member 61 extends through respective grooves 57 and 58 in the partitions 55 and 56 and with the upright member 62 confined between the partitions 55 and 56. With this arrangement, the upright member 62 acts to interrupt the grooves 57 and 58 to thereby improve the insulation efficiency between the contact assembly 30 and the electromagnet 10.

The terminals 17, 18, 33, and 36 extending downwardly through the base 40 are respectively sealed by a suitable sealer which is flown into generally rectangular pits 45 each formed around each of holes 43 through which the terminals 17, 18, 33 and 36 extend. The bottom of each pit 45 is sloped down to the hole 43 offset to one end of the corresponding pit 45 so that the sealer supplied in the pit 45 will be easily directed into the hole 43 to obtain complete sealing between each of the terminals and the corresponding hole.

Figure 7:
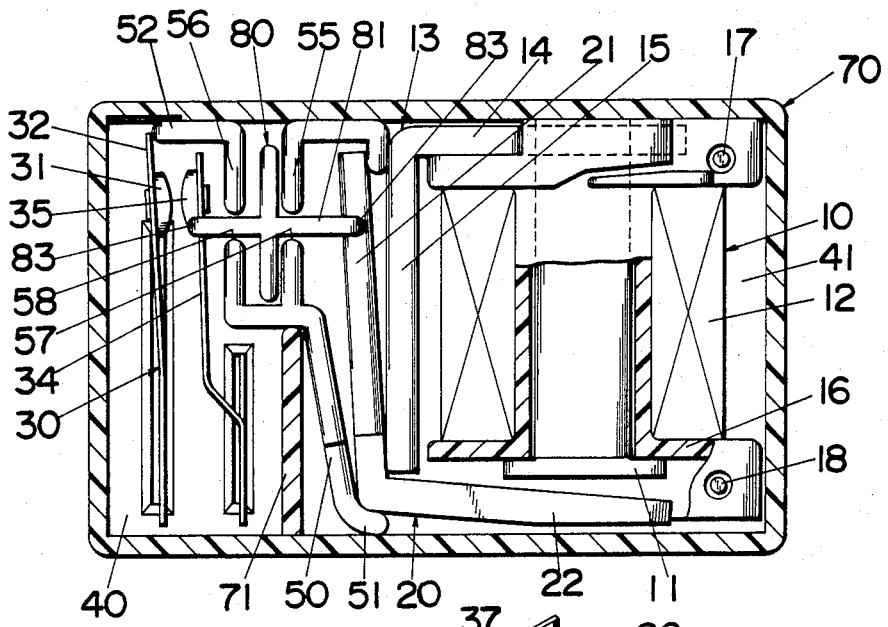
FIG. 7 is a top view of a relay of a modification of the above embodiment.
Figure 8:
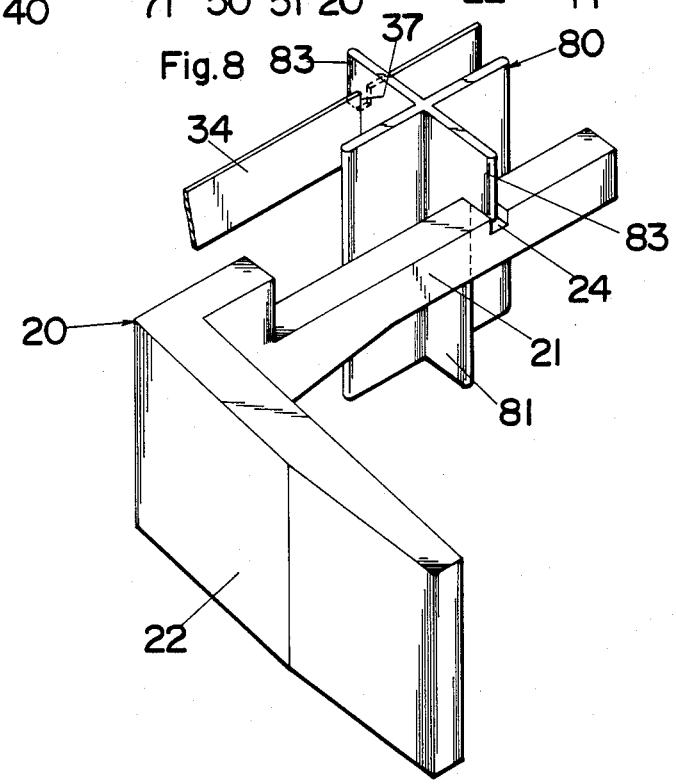
FIG. 8 is a perspective view of an actuator utilized in the relay of FIG. 7 and its connections.
Figure 7:
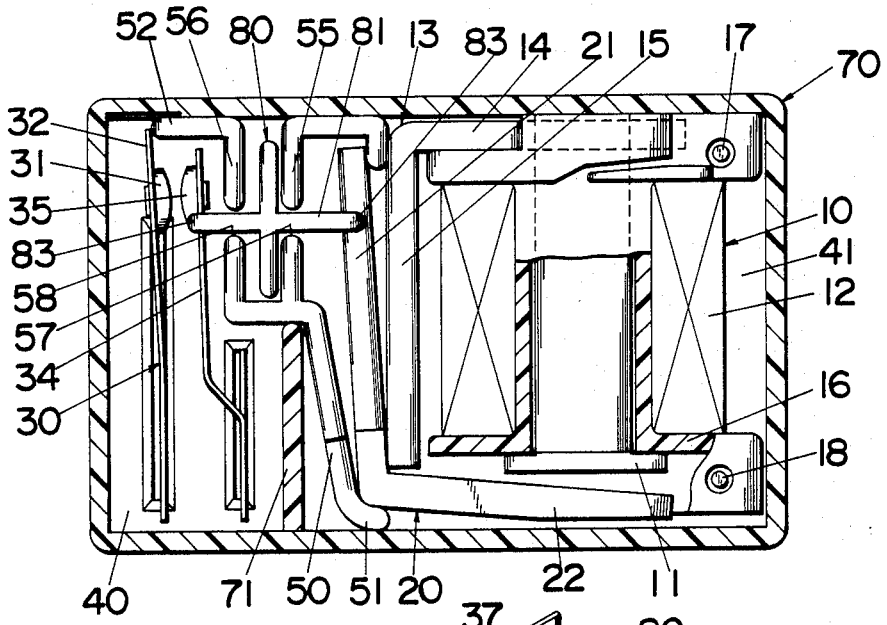
Figure 8:
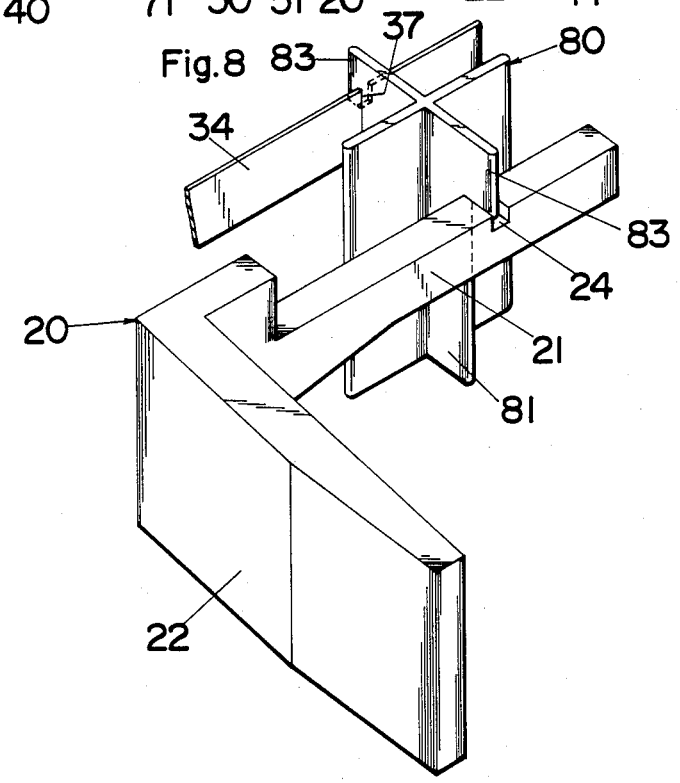

FIGS. 7 and 8 show a modification of the above relay which is identical in construction to the above embodiment except for a modified actuator 80 and its connections. Like numerals are used to designate like parts as in the above embodiment. The modified actuator 80 is also cross-shaped and is formed integrally with shoulders 83 which extend from the upper portion of the opposite ends of a horizontal member 81 and are engaged in indents 37 and 24 respectively formed in the upper edges of the movable spring 34 and the first armature leg 21, while the opposite ends of the horizontal member 81 below the shoulders 83 are kept urged against the movable springs 34 and the first armature leg 21. With this engagement, the actuator 80 is stably held between the movable spring 34 and the first armature leg 21 to be prevented from shifting along the length of the movable spring 34 or the first armature leg 21, giving a precise sliding movement to the actuator 80 without being guided by the grooves 57 and 58 in the partitions 55 and 56. This enables to widen the grooves 57 and 58 to eliminate the friction resistance between the horizontal member 81 and the edges of the grooves, effecting a smooth and delicate actuator movement.

What is claimed is:

1. In an electromagnetic relay comprising:

a base mounting an electromagnet and a contact assembly;

said contact assembly comprising a fixed contact on said base and an elongated movable spring carrying at its one end a movable contact engageable with said fixed contact and supported at the other end to said base;

said electromagnet including a core having first and second ends, a coil wound about said core, a yoke connected at its one end to the first end of the core and extending parallel to said core, and a generally L-shaped armature having a first leg extending along the yoke and a second leg extending over the second end of said core to define therebetween an air gap;

said armature rockable with its inside angle pivotally supported against an edge at the other end of said yoke for pivotal movement in response to the energization and deenergization of said coil between an attracted position in which the second armature leg is attracted to said second end of the core and a reset position in which the second armature leg is spaced away from the first end of said core;

said first armature leg being operatively connected to said movable spring through an electrically insulative actuator so as to drive the movable spring in a direction of engaging the movable contact with said fixed contact against a return bias applied to the armature as said armature moves to its attracted position in response to the energization of said coil, said return bias causing the armature to move back into said inoperative position for disengaging the movable contact from said fixed contact upon deenergization of the coil;

said relay characterized in that a stationary retainer means is provided on the base adjacent the angled portion of the armature to loosely engage that angled portion between the edge of the yoke and the retainer means for preventing said inside angle of the armature from departing beyond a predetermined allowable distance from the edge of the yoke;

that said movable spring is self-biased away from said fixed contact to thereby produce said return bias which is transmitted to said armature through said insulating actuator and said first armature leg while holding said insulative actuator between said movable spring and said first armature leg, and that a fulcrum projection is provided on the base to receive the free end of the first armature leg when the armature is moved to its reset position, said actuator abutting against the first armature leg at a point inwardly of said fulcrum projection along the length of the first armature leg for transmitting to the armature said return bias as a torque which causes said armature within said allowable distance from the edge of the yoke to pivot about the fulcrum projection in a direction of urging said inside angle of the armature toward the edge of said yoke close enough so that upon the energization of the coil the inside angle of the armature can be firstly attracted to the edge of the yoke before the second armature leg is attracted to the core to substantially drive the movable spring by the first armature leg into contact with the fixed contact, whereby the armature can have its inside angle in exact coincidence with the edge of the yoke prior to being pivoted to the attracted position.

2. An electromagnetic relay as set forth in claim 1, wherein said actuator abuts at its end on the first armature leg at such an inclined angle that said return bias applies a force which acts in a direction of urging the inside angle toward the edge of the yoke along the length of the yoke while applying said torque to pivot the armature about said fulcrum projection.

3. An electromagnetic relay as set forth in claim 2, further including a cover of electrically insulative material fitted over said base to define therebetween a mounting space for said electromagnet and contact assembly, said base being integrally formed with a dividing wall which divides said mounting space into a magnet compartment for said electromagnet and a contact compartment for said contact assembly, said dividing wall formed integrally with said retainer means at its one end and with said fulcrum projection at the other end, said retainer means being in the form of an arcuate rib having its inner curved surface centered on the edge of said yoke, said fulcrum projection resting on said yoke, said dividing wall having therein a slit through which said insulative actuator extends between said movable spring and said first armature leg.

4. An electromagnetic relay as set forth in claim 1, wherein said actuator is formed at its ends with hooks each extending from the top end of the actuator and engaging in a corresponding notch formed in each of the upper edges of said movable spring and the first armature leg.

* * * * *